US009070343B2

(12) United States Patent
Park et al.

(10) Patent No.: US 9,070,343 B2
(45) Date of Patent: Jun. 30, 2015

(54) METHOD OF DRIVING DISPLAY PANEL THAT PREVENTS TFT CHARACTERISTIC DEGRADATION AND DISPLAY APPARATUS FOR PERFORMING THE SAME

(75) Inventors: Jae-Hyun Park, Yongin-si (KR); Jong-Hwan Lee, Anyang-si (KR); Jae-Ho Choi, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 546 days.

(21) Appl. No.: 13/368,743

(22) Filed: Feb. 8, 2012

(65) Prior Publication Data

US 2012/0218244 A1 Aug. 30, 2012

(30) Foreign Application Priority Data

Feb. 25, 2011 (KR) ..... 10-2011-0017303

(51) Int. Cl.
*G09G 3/36* (2006.01)

(52) U.S. Cl.
CPC ..... *G09G 3/3696* (2013.01); *G09G 3/3648* (2013.01); *G09G 3/3677* (2013.01); *G09G 2310/067* (2013.01); *G09G 2320/0214* (2013.01); *G09G 2320/043* (2013.01)

(58) Field of Classification Search
CPC ..... G09G 3/3648; G09G 3/3677; G09G 2320/043; G09G 2310/067
USPC ..... 345/87, 98, 211
See application file for complete search history.

(56) References Cited

U.S. PATENT DOCUMENTS

| | | | | |
|---|---|---|---|---|
| 2006/0256050 | A1* | 11/2006 | Ikeda | 345/82 |
| 2008/0174591 | A1* | 7/2008 | Park et al. | 345/212 |
| 2009/0128527 | A1* | 5/2009 | Itakura et al. | 345/205 |
| 2009/0140968 | A1* | 6/2009 | Liao | 345/98 |
| 2009/0322727 | A1* | 12/2009 | Iwashimizu | 345/212 |
| 2011/0102310 | A1* | 5/2011 | Chiu et al. | 345/100 |
| 2013/0120321 | A1* | 5/2013 | Nemoto et al. | 345/175 |

FOREIGN PATENT DOCUMENTS

| | | | |
|---|---|---|---|
| JP | 2009-098373 | A | 5/2009 |
| KR | 1020070113769 | A | 11/2007 |
| KR | 1020080058956 | A | 6/2008 |

* cited by examiner

*Primary Examiner* — Jonathan Blancha
(74) *Attorney, Agent, or Firm* — Cantor Colburn LLP

(57) ABSTRACT

A method for driving a display panel includes generating a plurality of gate signals, providing the plurality of gate signals to a plurality of switching elements connected to a plurality of gate lines, respectively, providing the plurality of gate signals to a monitoring element, and restoring the plurality of switching elements based on an output signal from the monitoring element.

20 Claims, 5 Drawing Sheets

METHOD OF DRIVING DISPLAY PANEL THAT PREVENTS TFT CHARACTERISTIC DEGRADATION AND DISPLAY APPARATUS FOR PERFORMING THE SAME

This application claims priority to Korean Patent Application No. 2011-0017303, filed on Feb. 25, 2011, and all the benefits accruing therefrom under 35 U.S.C. §119, the content of which in its entirety is herein incorporated by reference.

BACKGROUND OF THE INVENTION

1. Field of the Invention

Exemplary embodiments of the invention relate to a method of driving a display panel and a display apparatus for performing the method. More particularly, exemplary embodiments of the invention relate to a method of driving a display panel that prevents characteristic degradation and a display apparatus performing the method.

2. Description of the Related Art

Generally, a liquid crystal display ("LCD") panel includes a display substrate, an opposing substrate facing the display substrate, and a liquid crystal layer disposed between the display substrate and the opposing substrate. The display substrate includes a display area, in which a plurality of lines and a plurality of transistors connected to the lines, are provided, and a peripheral area, in which a plurality of pads that supplies an electric signal to the lines, is provided.

The display substrate of the LCD panel includes gate and data lines, a thin-film transistor ("TFT") connected to the gate and data lines, and a pixel electrode connected to the TFT.

The TFT typically includes a gate electrode connected to the gate line, a semiconductor layer forming a channel, a source electrode connected to the data line, and a drain electrode facing the source electrode. The TFT is a type of a switching element which controls an image signal transmitted to the pixel electrode through the data line based on a gate signal transmitted through the gate line.

When a pixel including the TFT is activated during one frame, the gate electrode of the TFT receives a positive bias voltage. When the pixel is not activated, the gate electrode of the TFT receives a negative bias voltage.

When the LCD panel is driven for a substantial amount of time, the gate electrode of the TFT receives gate voltages of a same polarity for a substantial amount of time, such that a threshold voltage of the TFT may be changed. Therefore, an operating characteristic of the TFT may be changed, e.g., an off-level current is substantially increased, and thus the current may leaks out.

BRIEF SUMMARY OF THE INVENTION

Exemplary embodiments of the invention provide a method of driving a display panel that effectively prevents characteristic degradation in operating a thin-film transistor.

Exemplary embodiments of the invention also provide a display apparatus for performing the method.

According to an exemplary embodiment of the invention, a method for driving a display panel includes: generating a plurality of gate signals; providing the plurality of gate signals to a plurality of switching elements connected to a plurality of gate lines, respectively; providing the plurality of gate signals to a monitoring element; and restoring the plurality of switching elements based on an output signal from the monitoring element.

In an exemplary embodiment, the restoring the plurality of switching elements may include: controlling the monitoring element to generate the output signal of the monitoring element in a restoration mode; determining whether or not to restore the plurality of switching elements based on the output signal of the monitoring element; and outputting a restoration signal to the plurality of switching elements based on a result of the determination.

In an exemplary embodiment, the determining whether or not to restore the plurality of switching elements may include comparing the output signal of the monitoring element with an initial value, a maximum allowable value and a minimum allowable value of at least one of the switching elements.

In an exemplary embodiment, the outputting the restoration signal to the plurality of switching elements may include: outputting a first restoration signal when the output signal of the monitoring element is greater than or equal to the maximum allowable value; and outputting a second restoration signal when the output signal of the monitoring element is less than or equal to the minimum allowable value.

In an exemplary embodiment, the first restoration signal may be a gate-on voltage, and the second restoration signal may be a gate-off voltage.

In an exemplary embodiment, the restoring the plurality of switching elements may be repeated until the output signal of the monitoring element is greater than the minimum allowable value and less than the maximum allowable value.

According to another exemplary embodiment of the invention, a display apparatus includes: a display panel including a plurality of gate lines and a plurality of switching elements connected to the gate lines, respectively; a gate driving circuit which generates a plurality of gate signals and provides the plurality of gate signals to the plurality of gate lines, respectively; and a restoration unit connected to the gate driving circuit, where the restoration unit monitors the plurality of switching elements and transmits a restoration signal to the plurality of switching elements.

In an exemplary embodiment, the display apparatus may further include a voltage selector which determines whether or not to restore the plurality of switching elements and selects the restoration signal by receiving an output signal of the restoration unit in a restoration mode.

In an exemplary embodiment, the restoration unit may include a restoration signal transmitting unit, and the restoration signal transmitting unit may include: a restoration signal transmitting line connected to the voltage selector, where the restoration signal transmitting line receives the restoration signal from the voltage selector; and a plurality of restoration elements connected to the restoration signal transmitting line, where the plurality of restoration elements applies the restoration signal to the plurality of switching elements.

In an exemplary embodiment, each of the plurality of restoration elements may include an output terminal connected to a corresponding gate line of the plurality of gate lines, an input terminal connected to the restoration signal transmitting line, and a control terminal connected to the restoration signal transmitting line.

In an exemplary embodiment, the restoration unit may include a monitoring unit, and the monitoring unit may include: a monitoring element having a structure substantially the same as a structure of each of the plurality of switching elements, where the monitoring element outputs an output signal to the voltage selector in a restoration mode; and a switch which controls the monitoring element.

In an exemplary embodiment, the monitoring element may include a control terminal connected to one of the plurality of gate lines and a ground terminal, and an output terminal connected to the voltage selector.

In an exemplary embodiment, the switch may be connected to the control terminal of the monitoring element.

In an exemplary embodiment, the plurality of gate lines may include first to m-th gate lines connected to the plurality of switching elements, the gate driving circuit may include first to m-th driving stages connected to the first to m-th gate lines, respectively, and the first to m-th driving stages may sequentially output first to m-th gate signals to the first to m-th gate lines, respectively.

In an exemplary embodiment, the display panel may include a dummy gate line connected to the control terminal of the monitoring element and not connected to the plurality of switching elements.

In an exemplary embodiment, the gate driving circuit may include a dummy stage which controls the m-th driving stage, and the dummy stage may output a gate signal to the dummy gate signal.

In an exemplary embodiment, the voltage selector may include a memory which stores an initial value, a maximum allowable value and a minimum allowable value of at least one of the plurality of switching elements.

In an exemplary embodiment, the voltage selector may compare the output signal of the monitoring element with the initial value, the maximum allowable value and the minimum allowable value of the switching element, and may output the restoration signal to the restoration signal transmitting line based on a result of the comparison.

In an exemplary embodiment, the voltage selector may output a first restoration signal when the output signal of the monitoring element is greater than or equal to the maximum allowable value, and may output a second restoration signal when the output signal of the monitoring element is less than or equal to the minimum allowable value.

According to exemplary embodiments of the invention, the characteristic of the switching element is effectively monitored using the monitoring element which may be simultaneously formed with the switching element of the display panel in a same process.

Thus, whether or not to restore the switching element is effectively determined, such that a current is effectively prevented from leaking out due to a change of the characteristic of the switching element, and the reliability of the display panel is substantially enhanced.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION OF THE INVENTION

Figure 1:
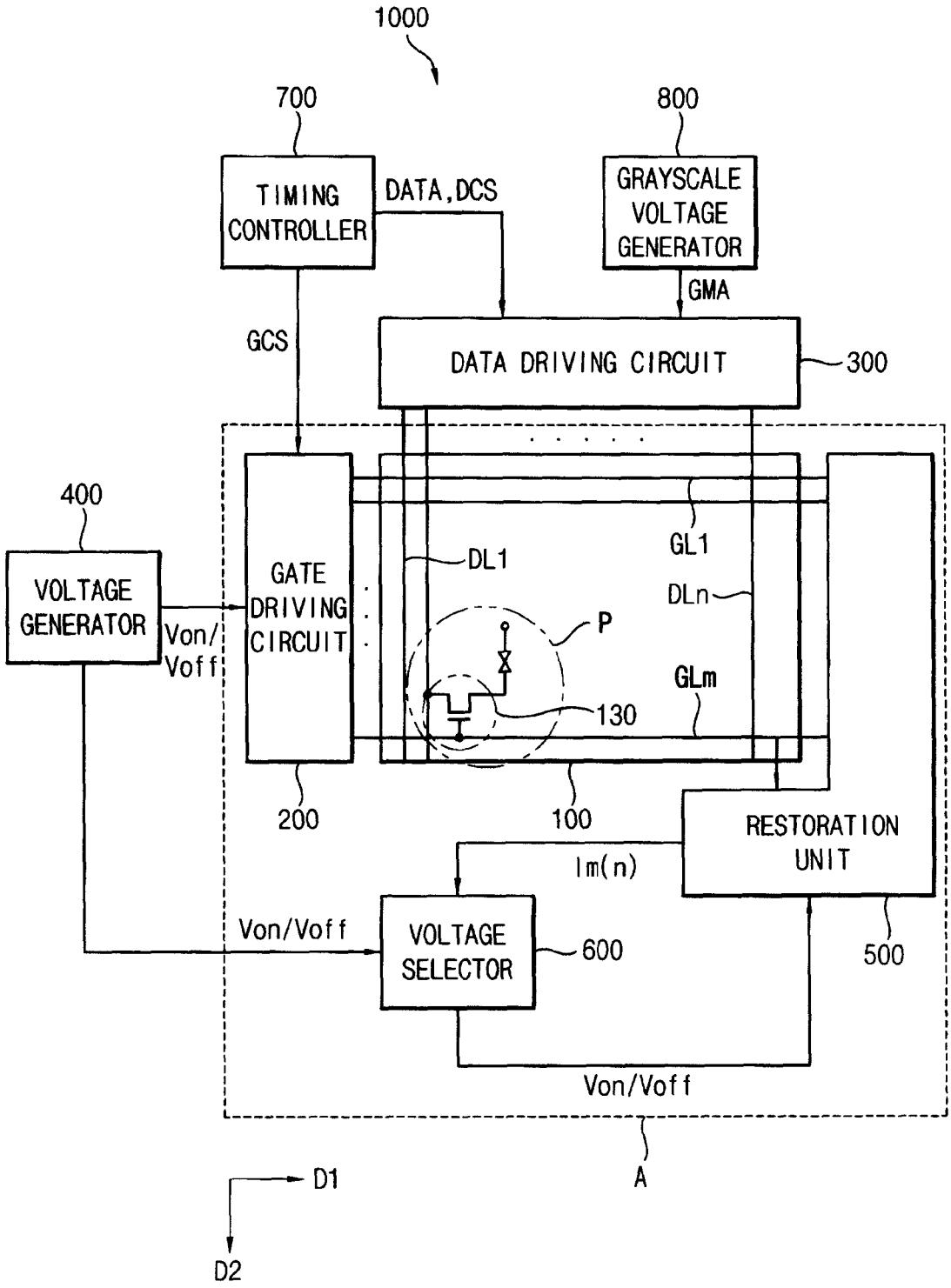
FIG. 1 is a block diagram illustrating an exemplary embodiment of a display apparatus according to the invention.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. As used herein, "connected" includes physically and/or electrically connected. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "under," "above," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "under" relative to other elements or features would then be oriented "above" relative to the other elements or features. Thus, the exemplary term "under" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be explained in detail with reference to the accompanying drawings.

FIG. 1 is a block diagram illustrating an exemplary embodiment of a display apparatus according to the invention.

Referring to FIG. 1, a display apparatus 1000 includes a display panel 100, a gate driving circuit 200, a data driving circuit 300, a voltage generator 400, a restoration unit 500, a voltage selector 600, a timing controller 700 and a grayscale voltage generator 800.

The display panel 100 includes a plurality of gate lines GL1 to GLm, a plurality of data lines DL1 to DLn, and a plurality of pixels P. The gate lines GL1 to GLm extend along the first direction D1. The data lines DL1 to DLn extend along a second direction D2 crossing the first direction D1. Each of the pixels P includes a switching element 130 connected to the gate and data lines and a pixel electrode (not shown) electrically connected to the switching element 130.

The gate driving circuit 200 is connected to an end portion of the gate lines GL1 to GLm. The gate driving circuit 200 generates a plurality of gate signals based on a gate control signal GCS provided from the timing controller 700 and gate-on/off voltages Von/Voff provided from the voltage generator 400. The gate driving circuit 200 sequentially applies the gate signals to the gate lines GL1 to GLm arranged on the display panel 100.

The gate driving circuit 200 may include a plurality of gate driving integrated circuits ("IC"s) (not shown). In an exemplary embodiment, the gate driving ICs may include a plurality of switching elements directly formed in a peripheral area of the display panel 100. In an exemplary embodiment, the switching element may be simultaneously formed with the switching element 130 of the pixel P in a display area of the display panel 100 in a same process.

The data driving circuit 300 is connected to an end portion of the data lines DL1 to DLn. The data driving circuit 300 receives a data signal DATA and a data control signal DCS, provided from the timing controller 700, and grayscale voltages GMA, provided from the grayscale voltage generator 800. The data driving circuit 300 converts the data signal DATA into an analogue data voltage based on the grayscale voltages GMA, and applies the analogue data voltage to the data lines DL1 to DLn arranged on the display panel 100.

The data driving circuit 300 may include a plurality of data driving ICs (not shown).

The voltage generator 400 generates the gate-on/off voltages Von/Voff provided to the gate driving circuit 200 and the voltage selector 600.

The restoration unit 500 receives the gate signal from at least one of the gate lines GL1 to GLm on the display panel 100, to monitor a current characteristic of the switching element 130 of the pixel P. When the display apparatus 1000 does not display an image in a sleeping mode or a restoration mode, the restoration unit 500 provides a restoration signal to all gate lines GL1 to GLm. The restoration signal restores a characteristic of the switching element 130 based on the current characteristic of the switching element 130.

Although the restoration unit 500 and the display panel 100 are individually illustrated in FIG. 1, the restoration unit 500 and the display panel 100 may be disposed together on substantially a same substrate.

The voltage selector 600 receives an output signal Im(n) from the restoration unit 500 based on monitoring the current characteristic of the switching element 130 of the pixel P, and determines whether or not to restore the switching element 130 in the sleeping mode or the restoration mode. When the switching element 130 is restored, the voltage selector 600 outputs the restoration signal to the restoration unit 500. In such an embodiment, the gate-on/off voltages Von/Voff may be used as the restoration signal, but not being limited thereto and may be variously changed. In one alternative exemplary embodiment, for example, the display apparatus may generate an additional restoration signal different from the gate-on/off voltages Von/Voff.

An operation of the restoration unit 500 and the voltage selector 600 will be described later in greater detail.

The timing controller 700 provides the gate driving circuit 200 with the gate control signal GCS. In addition, the timing controller 700 provides the data driving circuit 300 with the data signal DATA and the data control signals DCS. The gate and data control signals GCS and DCS control the display panel 100.

The grayscale voltage generator 800 generates the grayscale voltages GMA having positive and negative polarities based on luminance of the display panel 100. The grayscale voltages GMA are outputted to the data driving circuit 300.

Figure 2:
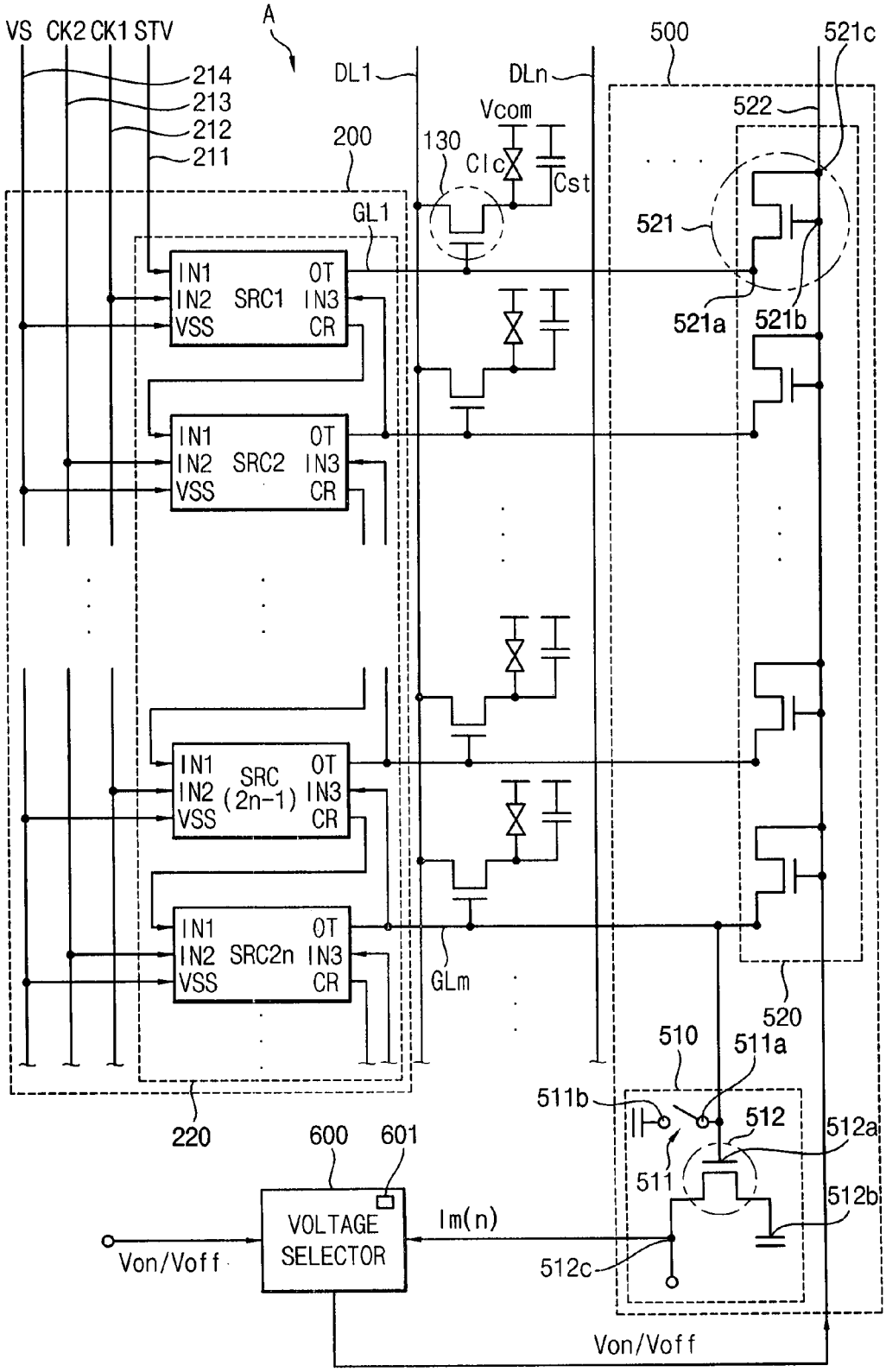
FIG. 2 is an equivalent circuit diagram of a portion 'A' of the display apparatus in FIG. 1.

FIG. 2 is an equivalent circuit diagram of 'A' of the display apparatus in FIG. 1. In an exemplary embodiment, as shown in FIG. 2, the gate driving circuit 200 may be a shift resistor including a plurality of stages. However, the gate driving circuit is not limited to the shift resistor, and may be variously changed.

Referring to FIGS. 1 and 2, each of the pixels P of the display panel 100 includes a liquid crystal capacitor Clc connected to the switching element 130 and a storage capacitor Cst connected to the liquid crystal capacitor Clc and the switching element 130.

The gate driving circuit 200 includes a plurality of lines, e.g., a vertical starting line 211, a first clock line 212, a second clock line 213 and an off line 214, which transmits a plurality of signals, and a shift resistor 220 electrically connected to the lines 211, 212, 213 and 214. The gate driving circuit 200 receives a vertical starting signal STV, first and second clock signals CK1 and CK2, and an off signal VS.

The shift resistor 220 includes first to m-th driving stages SRC1 to SRCm cascade-connected with each other. The shift resistor 220 is connected to the vertical starting line 211, the first clock line 212, the second clock line 213 and the off line 214.

The vertical starting line 211 transmits the vertical starting signal STV. The vertical starting signal STV is inputted to a first input terminal IN1 of the first driving stage SRC1. A carry signal, which is outputted from a carry terminal CR of a previous driving stage, is inputted to a subsequent driving stage. In an exemplary embodiment, each of first input terminals N1 of the second to m-th driving stages SRC2 to SRCm receives the carry terminal CR of a previous driving stage thereof. The vertical starting signal STV is a pulse signal having one frame period. A high level of the vertical starting signal STV may be substantially the same as a level of the gate-on voltage Von, and a low level of the vertical starting signal STV may be substantially the same as a level of the gate-off voltage Voff.

The first clock line 212 transmits the first clock signal CK1. The first clock signal CK1 is inputted to a second input terminal IN2 of the odd-numbered driving stages SRC1, . . . , SRC(2*n*−1), SRC(2*n*+1).

The second clock line 213 transmits the second clock signal CK2. The second clock signal CK2 is different from the first clock signal CK1. The second clock signal CK2 may be a pulse signal having a phase opposite to a phase of the first clock signal CK1. The second clock signal CK2 is inputted to a second input terminal IN2 of the even-numbered driving stages SRC2, . . . , SRC2*n*, SRC(2*n*+2).

The off line 214 transmits the off signal VS. The off signal VS may a level substantially the same as the level of the gate-off voltage Voff. In one exemplary embodiment, for example, the level of the off signal VS may be about −7 volts (V). The off signal VS is inputted to an off terminal VSS of the driving stages SRC1 to SRCm.

Each of the driving stages SRC1 to SRCm includes an output terminal OT which outputs a gate signal. The output terminal OT of each of the first to m-th driving stages SRC1 to SRCm is electrically connected to a corresponding cage line of the gate lines GL1 to GLm. In addition, the output terminal OT outputs the gate signal to a third input terminal IN3 of the previous driving stage.

The restoration unit 500 includes a monitoring unit 510 and a restoration signal transmitting unit 520. The monitoring unit 510 includes a monitoring element 512 and a switch 511. The restoration signal transmitting unit 520 includes a restoration element 521 and a restoration signal transmitting line 522.

The restoration signal transmitting line 522 is connected to the voltage selector 600 and the restoration element 521. An output terminal 521*a* of the restoration element 521 is connected the gate lines GL1 to GLm. A control terminal 521*b* and an input terminal 521*c* of the restoration element 521 are connected to the restoration signal transmitting line 522.

In an exemplary embodiment, the monitoring element 512 and the switching element 130 of the pixel P are simultaneously formed in a same process, and thus the monitoring element 512 has a characteristic substantially the same as the characteristic of the switching element 130 of the pixel P. A control terminal 512*a* of the monitoring element 512 is connected to one gate line GL to receive the gate signal of the gate line GL, an input terminal 512*b* of the monitoring element 512 is connected to a ground terminal, and an output terminal 512*c* of the monitoring element 512 is connected to the voltage selector 600. A first end 511*a* of the switch 511 is connected to the control terminal 512*a* of the monitoring element 512, and a second end 511*b* of the switch 511 is connected to the ground terminal.

When the display apparatus 1000 displays an image, the monitoring element 512 receives the gate signal through the one gate line GL, and operates in a manner substantially similar to an operation of the switching element 130. When the display apparatus 1000 does not display an image in the sleeping mode or the restoration mode, the switch 511 is turned on to provide a ground voltage to the control terminal 512*a* of the monitoring element 512, and the output signal Im(n) of the monitoring element 512 is inputted to the voltage selector 600.

In an exemplary embodiment, the monitoring element 512 and the switching element 130 of the pixel P may be simultaneously formed in a same process, such that a characteristic of the switching element 130 is monitored by the output signal Im(n) of the monitoring element 512.

The voltage selector 600 determines whether or not to restore the switching element 130, based on the output signal Im(n) of the monitoring element 512.

In one exemplary embodiment, for example, the voltage selector 600 includes a memory 601 which stores an initial output value Im of the switching element 130, a maximum allowable value Im+α (shown in FIG. 4) of the switching element 130, and a minimum allowable value Im−α (shown in FIG. 4) of the switching element 130. The memory 601 may be an electrically erasable programmable read-only memory ("EEPROM"). In an exemplary embodiment, α may be about 0.5 nanoampere (nA). When the output signal Im(n) of the monitoring element 512 is greater than or equal to the maximum allowable value Im+α, the voltage selector 600 transmits a first restoration signal to the restoration signal transmitting line 522. In one exemplary embodiment, for example, the first restoration signal may be the gate-on voltage Von. When the output signal Im(n) of the monitoring element 512 is less than or equal to the minimum allowable value Im−α, the voltage selector 600 transmits a second restoration signal to the restoration signal transmitting line 522. In one exemplary embodiment, for example, the second restoration signal is the gate-off voltage Voff. When the output signal Im(n) of the monitoring element 512 is greater than the minimum allowable value Im−α and less than the maximum allowable value Im+α, the voltage selector 600 does not transmit a restoration signal to the restoration signal transmitting line 522, and the restoration mode is terminated.

The output signal Im(n) of the monitoring element 512 is measured and the first and second restoration signals are transmitted repeatedly until the output signal Im(n) of the monitoring element 512 is greater than the minimum allowable value Im−α and less than the maximum allowable value Im+α.

The characteristic of the switching element 130 is restored by driving the display apparatus in the restoration mode.

Data voltages are not applied to the data lines DL1 to DLn in the restoration mode. Thus, a liquid crystal layer of the display panel 100 is not deteriorated.

In the illustrated exemplary embodiments, one monitoring element 512 is shown, but not being limited thereto, and may be variously changed. In one exemplary embodiment, for example, at least two monitoring elements may be connected to each of the gate lines, and the switching element may be monitored.

Figure 3:
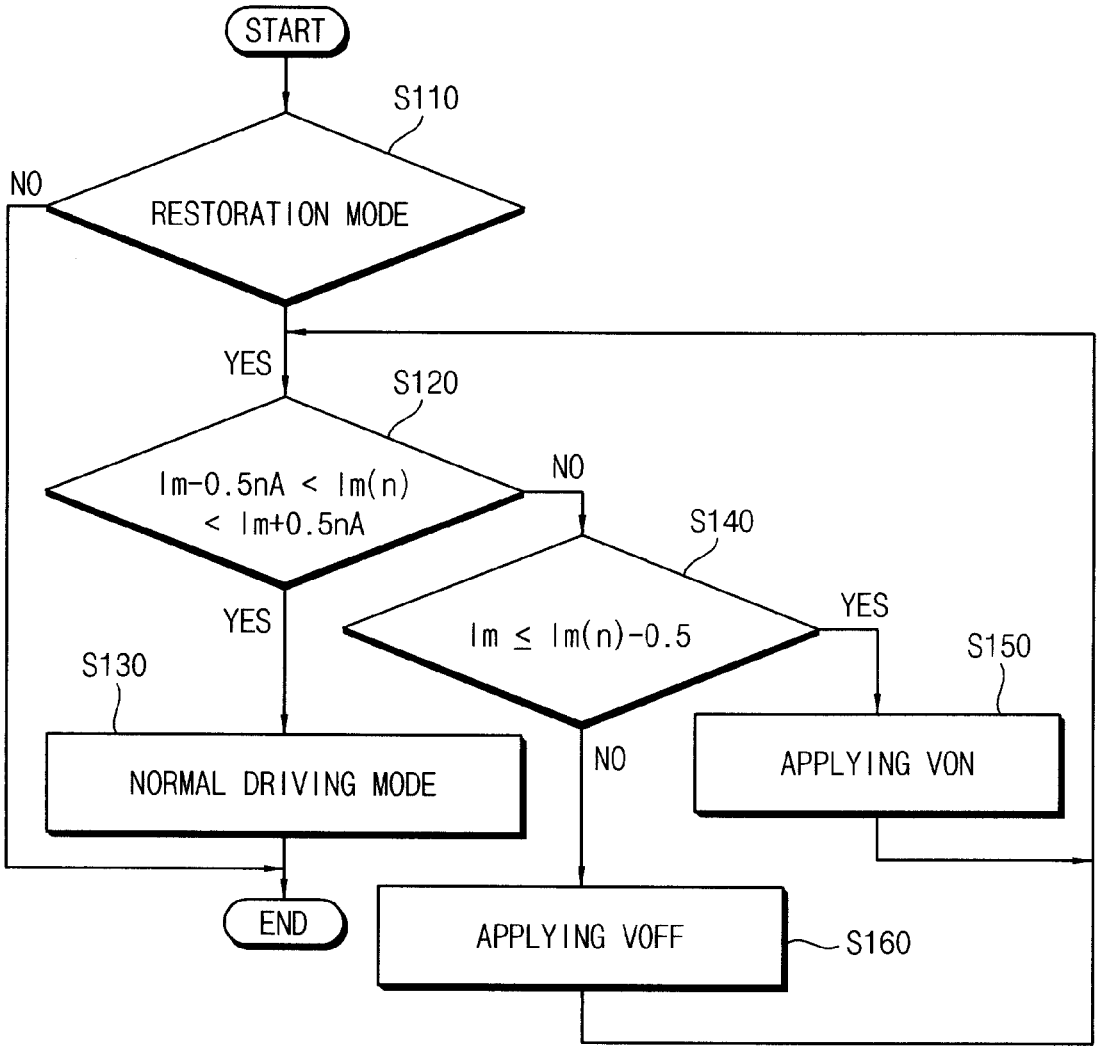
FIG. 3 a flow chart illustrating an exemplary embodiment of a method of driving the display apparatus of FIG. 1.
Figure 4:
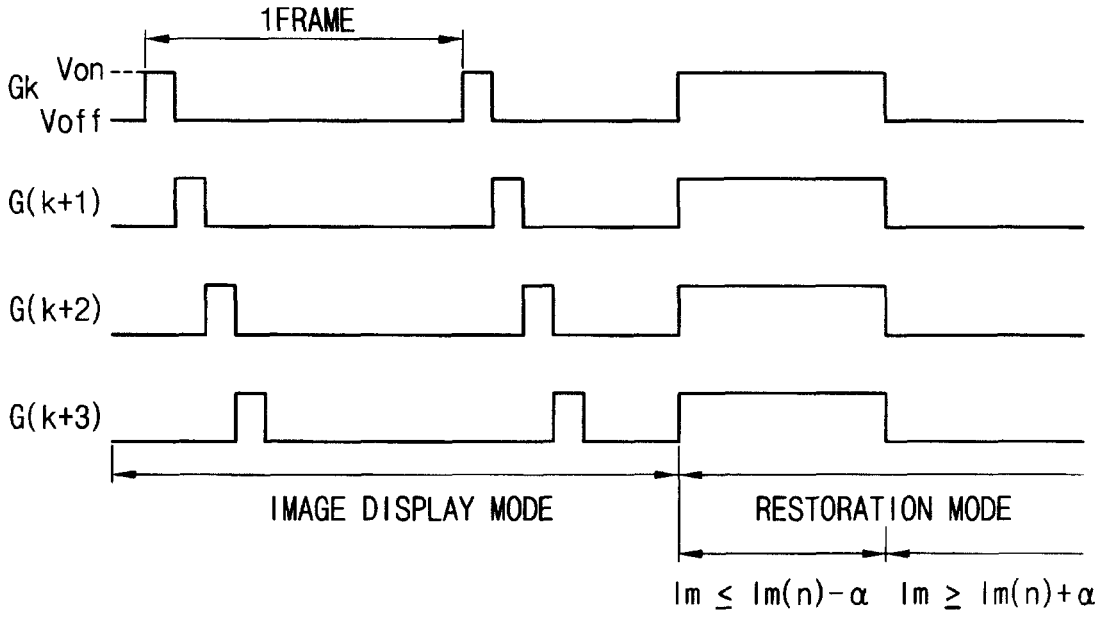
FIG. 4 is a signal timing diagram of signals applied to gate lines of FIG. 1.

FIG. 3 a flow chart illustrating an exemplary embodiment of a method of driving the display apparatus of FIG. 1. FIG. 4 is a signal timing diagram of signals applied to the gate lines of FIG. 1.

Referring to FIGS. 2, 3 and 4, the gate signals Gk, G(k+1), G(k+2) and G(k+3) are sequentially and respectively provided to the gate lines GLk, GL(k+1), GL(k+2) and GL(k+3) when the display apparatus 1000 displays an image. The gate signals Gk, G(k+1), G(k+2) and G(k+3) are signals having one frame period. When the gate lines GLk, GL(k+1), GL(k+2) and GL(k+3) is activated, the gate signals Gk, G(k+1), G(k+2) and G(k+3) applies the gate-on voltage Von to the gate lines GLk, GL(k+1), GL(k+2) and GL(k+3), respectively. When the gate lines GLk, GL(k+1), GL(k+2) and GL(k+3) is not activated, the gate lines GLk, GL(k+1), GL(k+2) and GL(k+3) maintain the gate-off voltage Voff. In one exemplary embodiment, for example, the gate-on voltage Von may be about 20 V, and the gate-off voltage Voff may be about −7 V.

When the image display mode of the display apparatus 1000 is terminated, the voltage selector 600 determines whether or not to be driven in the restoration mode (step S110). In an exemplary embodiment, when the display apparatus 1000 is a device having the sleeping mode, e.g., a laptop or a monitor, the display apparatus 1000 may determine whether or not to be driven in the restoration mode right before the display apparatus 1000 is driven in the sleeping mode. In an alternative exemplary embodiment, when the display apparatus 1000 is a device having not sleeping mode, e.g., a television, the display apparatus 1000 may determine whether or not to be driven in the restoration mode right before the display apparatus 1000 is turned off.

When the display apparatus 1000 is not driven in the restoration mode, the display apparatus 1000 maintains normal driving conditions. In an exemplary embodiment, when the display apparatus 1000 is a device having the sleeping mode, the display apparatus 1000 may maintain the sleeping mode. In an alternative exemplary embodiment, when the display apparatus 1000 is a device having no sleeping mode, the display apparatus 1000 may maintain to be turned off.

When the display apparatus 1000 is driven in the restoration mode, the voltage selector 600 measures the output signal Im(n) of the monitoring element 512, and compares the measured output signal Im(n) with the maximum and minimum allowable values Im+α and Im−α of the switching element 130 stored in the memory 601 (step S120).

When the output signal Im(n) of the monitoring element 512 is greater than the minimum allowable value Im−α and less than the maximum allowable value Im+α, the voltage selector 600 terminates the restoration mode, and maintains the normal driving condition (step S130).

When the output signal Im(n) of the monitoring element 512 is greater than or equal to the maximum allowable value Im+α, the voltage selector 600 provides the first restoration signal to the restoration signal transmitting line 522 (steps S140 and S150). The first restoration signal may be the gate-on voltage Von.

The first restoration signal outputted to the restoration signal transmitting line 522 is provided to the gate lines GL1 to GLm through the restoration element 521. Thus, the characteristic of the switching element 130 is restored.

When the output signal Im(n) of the monitoring element 512 is less than or equal to the minimum allowable value Im−α, the voltage selector 600 provides the second restoration signal to the restoration signal transmitting line 522 (steps S140 and S160). The second restoration signal may be the gate-off voltage Voff.

The second restoration signal outputted to the restoration signal transmitting line 522 is provided to the gate lines GL1 to GLm through the restoration element 521. Thus, the characteristic of the switching element 130 is restored.

The restoration unit 500 and the voltage selector 600 may repeat the steps S120, S140, S150 and S160 until the output signal Im(n) of the monitoring element 512 is greater than the minimum allowable value Im−α and less than the maximum allowable value Im+α.

According to the exemplary embodiments set forth herein, the characteristic of the switching element 130 according to the driving of the display panel 1000 is effectively monitored by the monitoring element 512, which is simultaneously formed with the switching element 130 of the pixel P in a same process.

In such an embodiment, the voltage selector 600 determines whether or not the switching element 130 needs to be restored, and restores the switching element 130. Thus, a current is prevented from leaking out due to a change of the characteristic of the switching element 130, and the reliability of the display panel 100 is enhanced.

The gate-on and gate-off voltages Von and Voff are used as the restoration signals, so that an additional voltage generator generating the restoration signal is unnecessary. In addition, the data voltages are not applied to the data lines DL1 to DLn, so that the liquid crystal layer is prevented from being deteriorated.

Figure 5:
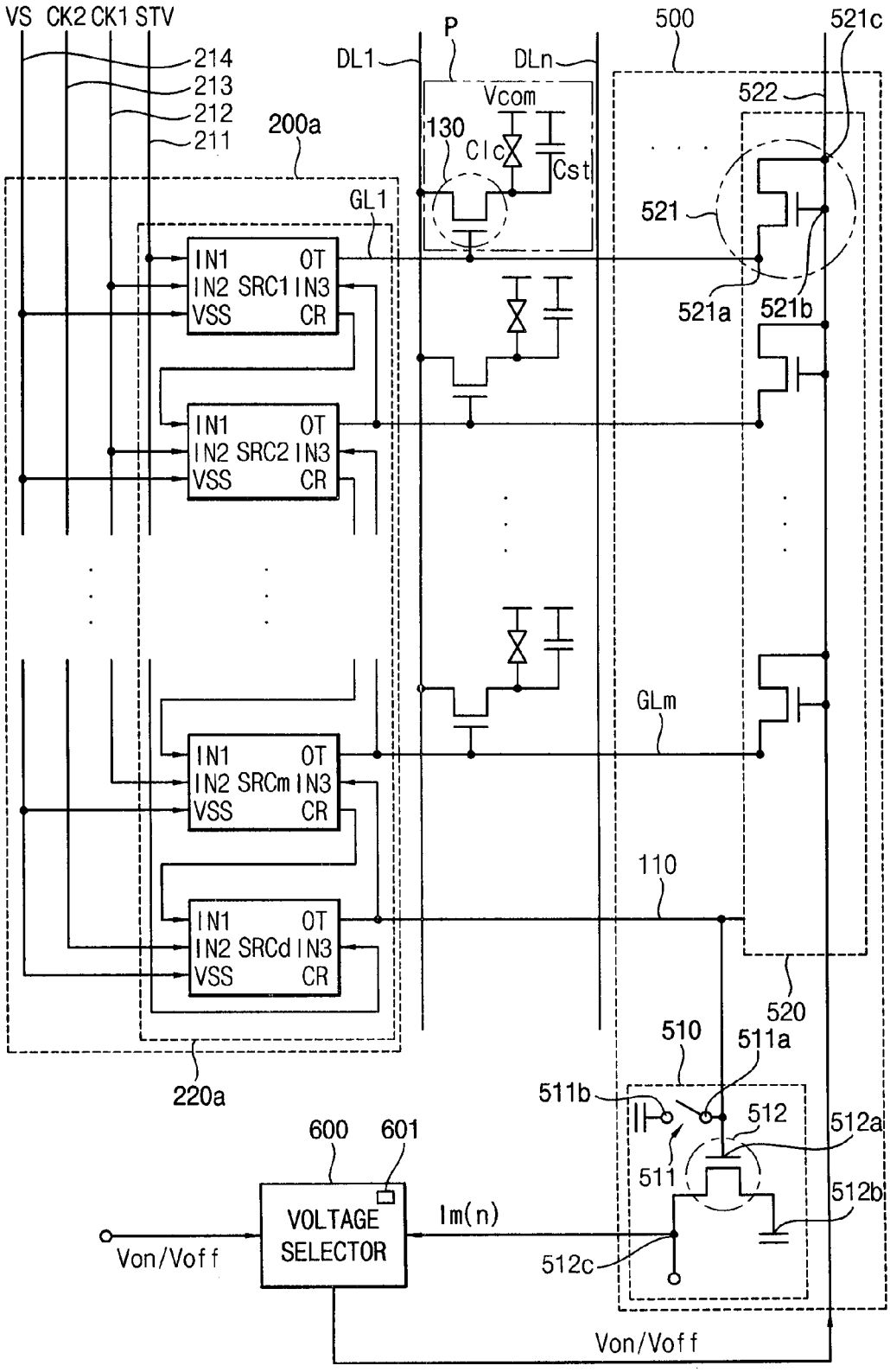
FIG. 5 is an equivalent circuit diagram illustrating a portion of an alternative exemplary embodiment of a display apparatus according to the invention.

FIG. 5 is an equivalent circuit diagram illustrating a portion of an alternative exemplary embodiment of a display apparatus according to the invention.

The display apparatus in FIG. 5 is substantially the same as the display apparatus in FIGS. 1 and 2 except for a monitoring unit and a gate driving circuit. The same or like elements shown in FIG. 5 have been labeled with the same reference characters as used above to describe the exemplary embodiments of the display apparatus shown in FIGS. 1 and 2, and any repetitive detailed description thereof will hereinafter be omitted or simplified.

Referring to FIG. 5, the display apparatus includes a display panel 100, a gate driving circuit 200*a*, a data driving circuit 300, a voltage generator 400, a restoration unit 500, a voltage selector 600, a timing controller 700 and a grayscale voltage generator 800.

The display panel 100 includes a plurality of gate lines GL1 to GLm, a plurality of data lines DL1 to DLn, a plurality of pixels P and a dummy gate line 110. The dummy gate line 110 may be substantially parallel to the gate lines GL1 to GLm. In one exemplary embodiment, for example, the dummy gate line 110 may be provided in an edge portion of the display panel 100 near the m-th gate line GLm.

The restoration unit 500 receives the gate signal from the dummy gate line 110 on the display panel 100.

In an exemplary embodiment, as shown in FIG. 5, the gate driving circuit 200*a* may be a shift resistor including a plurality of stages, but the gate driving circuit 200*a* is not limited to the shift resistor, and may be variously changed.

The gate driving circuit 200*a* includes a plurality of lines, e.g., a vertical starting line 211, a first clock line 212, a second clock line 213 and an off line 214, which transmits a plurality of signals, and a shift resistor 220*a* electrically connected to the lines 211, 212, 213 and 214. The gate driving circuit 200*a* receives a vertical starting signal STV, a plurality of clock signals CK1 and CK2, and an off signal VS.

The shift resistor 220*a* includes first to m-th driving stages SRC1 to SRCm cascade-connected with each other, and a dummy stage SRCd. The shift resistor 220*a* is connected to the vertical starting line 211, the first clock line 212, the second clock line 213 and the off line 214.

The vertical starting line 211 transmits the vertical starting signal STV. The vertical starting signal STV is inputted to a first input terminal IN1 of the first driving stage SRC1 and a third input terminal IN3 of the dummy stage SRCd. A carry signal, which is outputted from a carry terminal CR of a previous driving stage, is inputted to a first input terminal IN1 of a subsequent driving stage, e.g., the second to m-th driving stages SRC2 to SRCm. The vertical starting signal STV is a pulse signal having one frame period. A high level of the vertical starting signal STV may be substantially the same as a level of the gate-on voltage Von, and a low level of the vertical starting signal STV may be substantially the same as a level of the gate-off voltage Voff.

Each of the driving stages SRC1 to SRCm and the dummy stage SRCd include an output terminal OT which outputs a gate signal. Each of the output terminals OT of the first to m-th driving stages SRC1 to SRCm is electrically connected to each of the gate lines GL1 to GLm. In such an embodiment, each of the output terminals OT of the first to m-th driving stages SRC1 to SRCm outputs the gate signal to a third input terminal IN3 of a previous driving stage thereof.

The output terminal OT of the dummy stage SRCd is electrically connected to the dummy gate line 110. In such an embodiment, the output terminal OT of the dummy stage SRCd outputs the gate signal to a third input terminal IN3 of the m-the driving stages SRCm.

The restoration unit 500 includes a monitoring unit 510 and a restoration signal transmitting unit 520. The monitoring unit 510 includes a monitoring element 512 and a switch 511. The restoration signal transmitting unit 520 includes a restoration element 521 and a restoration signal transmitting line 522.

In one exemplary embodiment, for example, the monitoring element 512 and the switching element 130 of the pixel P are simultaneously formed in a same process to have a characteristic substantially the same as the characteristic of the switching element 130 of the pixel P. A control terminal 512*a* of the monitoring element 512 is connected to the dummy gate line 110 to receive the gate signal, an input terminal 512*b* of the monitoring element 512 is connected to a ground terminal, and an output terminal 512*c* of the monitoring element 512 is connected to the voltage selector 600. A first end 511 a of the switch 511 is connected to the control terminal 512*a* of the monitoring element 512, and a second end 511*b* of the switch 511 is connected to the ground terminal.

When the display apparatus displays an image, the monitoring element 512 receives the gate signal through the dummy gate line 110, and operates in a manner substantially the same as an operation of the switching element 130.

When the display apparatus 1000 does not display an image in a restoration mode, the switch 511 is turned on to provide a ground voltage to the control terminal 512*a* of the monitoring element 512, and an output signal Im(n) of the monitoring element 512 is inputted to the voltage selector 600.

In an exemplary embodiment, the monitoring element 512 and the switching element 130 of the pixel P are simultaneously formed in a same process, such that a characteristic of the switching element 130 is monitored by the output signal Im(n) of the monitoring element 512.

The voltage selector 600 determines whether or not to restore the switching element 130, based on the output signal Im(n) of the monitoring element 512.

When the display apparatus 1000 is driven in the restoration mode, data voltages are not provided to the data lines DL1 to DLn. Thus, a liquid crystal layer of the display panel 100 is not deteriorated.

According to exemplary embodiments, the characteristic of the switching element 130 according to the driving of the display panel 1000 is effectively monitored using the monitoring element 512 formed simultaneously with the switching element 130 of the pixel P in a same process.

In an exemplary embodiment, the voltage selector 600 determines whether or not to restore the switching element 130, and restores the switching element 130 base on the determination. Thus, a current is effectively prevented from leaking out due to a change of the characteristic of the switching element 130, and the reliability of the display panel 100 is substantially enhanced.

In an exemplary embodiment, the gate-on and gate-off voltages Von/Voff are used as the restoration signals, and an additional voltage generator to generate the restoration signal may be omitted. In an exemplary embodiment, the data voltages are not applied to the data lines DL1 to DLn, such that the liquid crystal layer is effectively prevented from being deteriorated.

According to exemplary embodiments, the characteristic of the switching element is effectively monitored using the monitoring element formed simultaneously with the switching element of the display panel in a same process.

Thus, whether or not to restore the switching element is effectively determined, such that a current is effectively prevented from leaking out due to a change of the characteristic of the switching element, and the reliability of the display panel is substantially enhanced.

The foregoing is illustrative of the present invention and is not to be construed as limiting thereof Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method for driving a display panel, the method comprising:

generating a plurality of gate signals;

providing the plurality of gate signals to a plurality of switching elements connected to a plurality of gate lines, respectively;

providing a gate signal of the plurality of gate signals to a monitoring element; and restoring the plurality of switching elements based on comparison of an output signal of the monitoring element with an initial value, a maximum allowable value and a minimum allowable value of at least one of the plurality of switching elements.

2. The method of claim 1, wherein the restoring the plurality of switching elements comprises:

controlling the monitoring element to generate the output signal of the monitoring element in a restoration mode;

determining whether or not to restore the plurality of switching elements based on the output signal of the monitoring element; and outputting a restoration signal to the plurality of switching elements based on a result of the determination.

3. The method of claim 2, wherein the determining whether or not to restore the plurality of switching elements comprises:

comparing the output signal of the monitoring element with the initial value, the maximum allowable value and the minimum allowable value of at least one of the plurality of switching elements.

4. The method of claim 3, wherein the outputting the restoration signal to the plurality of switching elements comprises:

outputting a first restoration signal when the output signal of the monitoring element is greater than or equal to the maximum allowable value; and outputting a second restoration signal when the output signal of the monitoring element is less than or equal to the minimum allowable value.

5. The method of claim 4, wherein the first restoration signal is a gate-on voltage, and the second restoration signal is a gate-off voltage.

6. The method of claim 1, wherein the restoring the plurality of switching elements is repeated until the output signal of the monitoring element is greater than the minimum allowable value and less than the maximum allowable value.

7. A display apparatus comprising:

a display panel including a plurality of gate lines, and a plurality of switching elements connected to the plurality of gate lines, respectively;

a gate driving circuit which generates a plurality of gate signals and provides the plurality of gate signals to the plurality of gate lines, respectively; and a restoration unit connected to the gate driving circuit, wherein the restoration unit monitors the plurality of switching elements and transmits a restoration signal to the plurality of switching elements based on comparison of an output signal of the monitoring element with an initial value, a maximum allowable value and a minimum allowable value of at least one of the plurality of switching elements.

8. The display apparatus of claim 7, further comprising:

a voltage selector which determines whether or not to restore the plurality of switching elements and selects the restoration signal by receiving an output signal of the restoration unit in a restoration mode.

9. The display apparatus of claim 8, wherein the restoration unit comprises a restoration signal transmitting unit, and the restoration signal transmitting unit comprises:

a restoration signal transmitting line connected to the voltage selector, wherein the restoration signal transmitting line receives the restoration signal from the voltage selector; and a plurality of restoration elements connected to the restoration signal transmitting line, wherein the plurality of restoration elements applies the restoration signal to the plurality of switching elements.

10. The display apparatus of claim 9, wherein each of the plurality of restoration elements comprises:

an output terminal connected to a corresponding gate line of the plurality of gate lines;

an input terminal connected to the restoration signal transmitting line; and a control terminal connected to the restoration signal transmitting line.

11. The display apparatus of claim 8, wherein the restoration unit comprises a monitoring unit, and the monitoring unit comprises:

a monitoring element having a structure substantially the same as a structure of each of the plurality of switching elements, wherein the monitoring element outputs an output signal to the voltage selector in a restoration mode; and a switch which controls the monitoring element.

12. The display apparatus of claim 11, wherein the monitoring element comprises:

a control terminal connected to one of the plurality of gate lines and a ground terminal; and an output terminal connected to the voltage selector.

13. The display apparatus of claim 12, wherein the switch is connected to the control terminal of the monitoring element.

14. The display apparatus of claim 11, wherein the plurality of gate lines comprises first to m-th gate lines connected to the plurality of switching elements, the gate driving circuit comprises first to m-th driving stages connected to the first to m-th gate lines, respectively, and the first to m-th driving stages sequentially output first to m-th gate signals to the first to m-th gate lines, respectively.

15. The display apparatus of claim 14, wherein the display panel further comprises a dummy gate line connected to the control terminal of the monitoring element and not connected to the plurality of switching elements.

16. The display apparatus of claim 15, wherein the gate driving circuit comprises a dummy stage which controls the m-th driving stage, and the dummy stage outputs a gate signal to the dummy gate line.

17. The display apparatus of claim 8, wherein the voltage selector comprises a memory which stores the initial value, the maximum allowable value and the minimum allowable value of the plurality of switching elements.

18. The display apparatus of claim 17, wherein the voltage selector compares the output signal of the monitoring element with the initial value, the maximum allowable value and the minimum allowable value of the switching element, and outputs the restoration signal to the restoration signal transmitting line based on a result of the comparison.

19. The display apparatus of claim 18, wherein the voltage selector outputs a first restoration signal when the output signal of the monitoring element is greater than or equal to the maximum allowable value, and outputs a second restoration signal when the output signal of the monitoring element is less than or equal to the minimum allowable value.

20. The display apparatus of claim 19, wherein the first restoration signal is a gate-on voltage, and the second restoration signal is a gate-off voltage.

* * * * *